US011759932B2

(12) United States Patent
Takeno et al.

(10) Patent No.: US 11,759,932 B2
(45) Date of Patent: Sep. 19, 2023

(54) COMPLIANT TIP FOR A FASTENING TOOL

(71) Applicant: Black & Decker, Inc., New Britain, CT (US)

(72) Inventors: Jillian Takeno, Catonsville, MD (US); Michael Cieszko, Baltimore, MD (US); Ross A. Billings, Reisterstown, MD (US)

(73) Assignee: Black & Decker, Inc., New Britain, CT (US)

( * ) Notice: Subject to any disclaimer, the term of this patent is extended or adjusted under 35 U.S.C. 154(b) by 0 days.

(21) Appl. No.: 17/264,260

(22) PCT Filed: Jun. 28, 2019

(86) PCT No.: PCT/US2019/039866

§ 371 (c)(1),
(2) Date: Jan. 28, 2021

(87) PCT Pub. No.: WO2020/006435

PCT Pub. Date: Jan. 2, 2020

(65) Prior Publication Data

US 2021/0291336 A1 Sep. 23, 2021

Related U.S. Application Data

(60) Provisional application No. 62/692,191, filed on Jun. 29, 2018.

(51) Int. Cl.
*B25C 1/18* (2006.01)
*B25C 7/00* (2006.01)

(52) U.S. Cl.
CPC ..... *B25C 1/188* (2013.01); *B25C 7/00* (2013.01)

(58) Field of Classification Search
CPC ..... B25C 1/188; B25C 7/00
See application file for complete search history.

(56) References Cited

U.S. PATENT DOCUMENTS 3,762,620 A * 10/1973 Geist ..... B25C 1/008 227/8
4,821,937 A * 4/1989 Rafferty ..... B25C 1/188 227/8

(Continued)

FOREIGN PATENT DOCUMENTS

JP 5015248 A2 1/1993

OTHER PUBLICATIONS

Written Opinion of the International Searching Authority, dated Oct. 23, 2019, for corresponding PCT No. PCT/US2019/039866.

(Continued)

*Primary Examiner* — Thomas M Wittenschlaeger
*Assistant Examiner* — Katie L Gerth
(74) *Attorney, Agent, or Firm* — Rhonda Barton

(57) ABSTRACT

A compliant tip member for a fastening tool that includes a body having compressible and protective properties includes a forward section, a rearward section longitudinally opposite to the forward section and lateral sides connecting the forward and rearward sections. The compressible feature is in the form of a compression portion that forms at least a portion of the forward section. The compliant tip member forward section is compressible relative to the rearward section due to projections, such as wings or lobes that deform when the forward section is pressed against a workpiece by the nose of the fastening tool. The compliant tip member includes a recess within a surface between the forward section and the rearward section. The recess is shaped to receive the nosepiece of the fastening tool.

31 Claims, 9 Drawing Sheets

(56) References Cited

U.S. PATENT DOCUMENTS 5,649,661 A * 7/1997 Masuno ..... B25C 7/00 227/8
5,743,455 A * 4/1998 Holliday ..... B25C 1/00 227/119
5,839,638 A 11/1998 Ronn
6,186,386 B1 * 2/2001 Canlas ..... B25C 1/008 227/8
6,371,348 B1 * 4/2002 Canlas ..... B25C 1/008 227/8
7,070,079 B2 7/2006 Smolinski et al.
7,255,256 B2 8/2007 McGee et al.
7,565,992 B2 7/2009 Buetow
7,845,532 B2 12/2010 Burke et al.
7,870,987 B1 * 1/2011 Zhang ..... B25C 1/008 227/107
8,056,785 B2 * 11/2011 Gosis ..... B25C 7/00 227/19
8,061,573 B2 11/2011 Kramer
8,104,658 B2 * 1/2012 Yu ..... B25C 5/1665 227/8
8,174,274 B2 5/2012 Lawrence et al.
8,292,143 B2 * 10/2012 Lee ..... B25C 1/008 227/8
8,308,038 B2 * 11/2012 Tanaka ..... B25C 7/00 227/18
8,387,846 B2 * 3/2013 Francis ..... B25C 7/00 227/156
8,627,991 B2 1/2014 Francis et al.
8,827,132 B2 9/2014 Mina et al.
8,833,626 B2 9/2014 Perron et al.
9,221,161 B2 12/2015 Miller et al.
9,469,021 B2 10/2016 Gregory et al.
10,173,310 B2 * 1/2019 Wyler ..... B25C 1/06
10,888,985 B2 * 1/2021 Ryan ..... B25C 7/00
2003/0041696 A1 * 3/2003 Lipsky ..... B25B 23/06 81/57.37
2005/0189396 A1 9/2005 Leasure et al.
2005/0194421 A1 * 9/2005 Smolinski ..... B25C 7/00 227/140
2006/0196682 A1 * 9/2006 McGee ..... B25C 1/041 227/119
2007/0057006 A1 * 3/2007 Moore ..... B25C 1/008 227/8
2008/0290128 A1 * 11/2008 Buetow ..... B25C 7/00 227/8
2009/0101690 A1 * 4/2009 Kubo ..... B25C 1/188 227/112
2012/0228354 A1 * 9/2012 Schwartzenberger .. B25C 1/188 227/123
2013/0175314 A1 7/2013 Francis et al.
2018/0099400 A1 * 4/2018 Wong ..... B25C 1/00

OTHER PUBLICATIONS

Extended European Search Report, dated Aug. 7, 2022, for corresponding EP Application No. 19825243.9-1017/3814061 PCT US/2019039866.

* cited by examiner

COMPLIANT TIP FOR A FASTENING TOOL

RELATED APPLICATIONS

This application is a national stage of PCT International Application No. PCT/US2019/039866 filed Jun. 28, 2019, which claims priority to U.S. provisional Patent Application No. 62/692,191 filed Jun. 29, 2018, the contents of which are incorporated herein by reference in entirety.

BACKGROUND OF THE INVENTION

Field of the Invention

The present disclosure relates to a no-mar tip that prevents indentations in a workpiece receiving a fastener from a powered fastening tool.

Description of the Related Art

This section provides background information related to the present disclosure which is not necessarily prior art.

In a fastening tool, fasteners, such as nails, are driven into a workpiece by a driver blade or driver through a process known as a "drive". The force of the drive is transmitted through the nose of the tool and into the workpiece when the fastener is driven. As a result, the workpiece can be dented or damaged by the tool nose being pressed against the surface of the workpiece. As an example, trim nailers are used to fasten trim moulding, base boards, chair rails and other decorative displays to drywall and other surfaces. Such workpieces are usually the final and most visible work product of a construction project. Accordingly, any fasteners should be invisible or easily disguised in the workpiece. Additionally, trim nailers should not damage the workpiece during the process of driving a fastener therein. However, damage to such workpieces includes denting caused by contact of the tip of the nose with the workpiece. Damage in the workpiece require additional work by the user to hide the damage by using putty or other camouflaging materials. As an alternative, many users attach a protective tip to the nosepiece of the nailer. As shown in FIG. 1, the protective or no-mar tip 2 is a covering for the nosepiece designed to prevent or reduce damage to the workpiece by the nosepiece or work contact element (WCE). However, existing no-mar tips do not provide a customizable body that conforms to varying contoured workpiece surfaces to prevent marring of such surfaces by the WCE. As shown, in FIG. 2, the existing no-mar tip has a single non-compliant body 4. The non-compliant body 4 provides only a point contact 6 on curved surfaces such, for example, the concave 8, 10 and convex 12 surfaces of the workpiece W shown in FIG. 2. As such, a non-compliant tip requires more time and effort to complete projects/jobs. A non-compliant tip adds steps to the fastening process or makes certain steps harder. For example, damage to the workpiece requires the user to revisit the fastening steps and add putty to cover dents in the workpiece. In addition, the user may have to re-finish/re-paint some spots. Alternatively, the user may install the trim in an unfinished/unpainted state and at a later time need to finish/paint the trim after it is nailed to the wall in an effort to avoid damage to the wood finish/paint. Such a process is more difficult for the user and increases the trim installation time. Thus, the non-compliant tip has drawbacks that include (1) possible denting of the workpiece, (2) damage the finish/paint on the workpiece if the user finished/painted the workpiece before nailing it to a wall, and (3) too much force on the workpiece from a point contact can split/crack the workpiece in some cases.

As such, there is a need in the art for a compliant no-mar tip that can accommodate varying workpiece surfaces and increase the surface area of contact with more surface curve types.

SUMMARY OF THE INVENTION

In an embodiment, the present invention is a compliant no-mar tip that is removably attachable to the tip of the nose portion of a fastening tool. In an embodiment, the compliant no-mar tip or compliant tip member surrounds the tip of the nose and therefore, provides an increased contact surface area for the fastening tool. The compliant tip member can include a compression area that allows the compliant tip member to conform to the shape of the workpiece, such as contoured trim moulding and other contoured surfaces, against which the tip is pressed. In an embodiment, the compliant tip member can have two compression areas. Alternatively, the compliant tip member can have more than two, or a plurality of compression areas. By including compression areas, the compliant tip member compresses to conform to the shape or contour of the workpiece. The compliant tip member conforms better than existing rigid or non-conforming no-mar tips. In particular, the compression areas or portion, when compressed, increase the surface area of the front face that contacts the workpiece. The increased surface area of contact resulting from the compliant forward section having a conforming or deformable front wall, allows for an optimized or improved contact between the tip member and the workpiece. The conforming/compression feature causes the tip to have increased surface area on different kinds of surfaces, which causes an improved distribution of force from the tool WCE, over a non-compliant tip, resulting in improved contact.

By increasing the contact surface area, the risk of damaging the workpiece is reduced. The invention can also include a concave and convex profile to adapt to differently contoured workpiece surfaces, such as differently contoured trim or crown moulding.

An advantage of the compliant tip member is can accomplish fastening into different curvatures of trim with a single tip member. The user would not have to switch to a different tip between nailing on concave and convex surfaces. Having a single compliant tip allows the user to fasten on different types of workpiece surfaces without adjusting the tool or switching to different rigid tips.

Further areas of applicability will become apparent from the description provided herein. It should be understood that the description and specific examples in this summary are intended for purposes of illustration only and are not intended to limit the scope of the present disclosure, its application and/or uses in any way.

BRIEF DESCRIPTION OF THE DRAWINGS

Embodiments of the invention will now be described, by way of example only, with reference to the accompanying schematic drawings in which corresponding reference symbol indicate corresponding parts, and in which.

DESCRIPTION OF THE INVENTION

Figure 1:
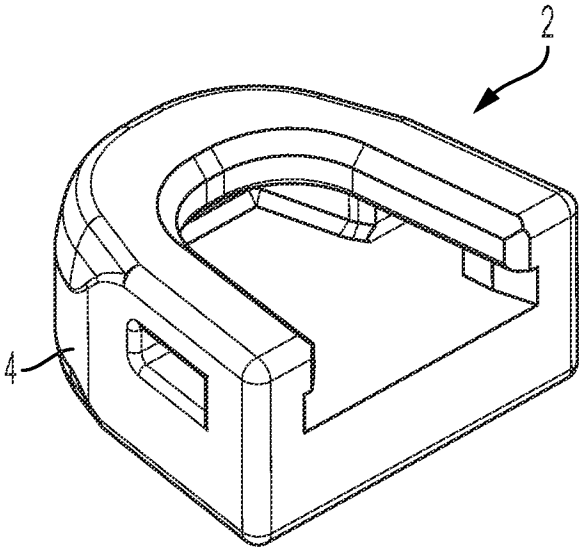
FIG. 1 PRIOR ART
FIG. 1 illustrates an existing non-compliant tip.
Figure 2:
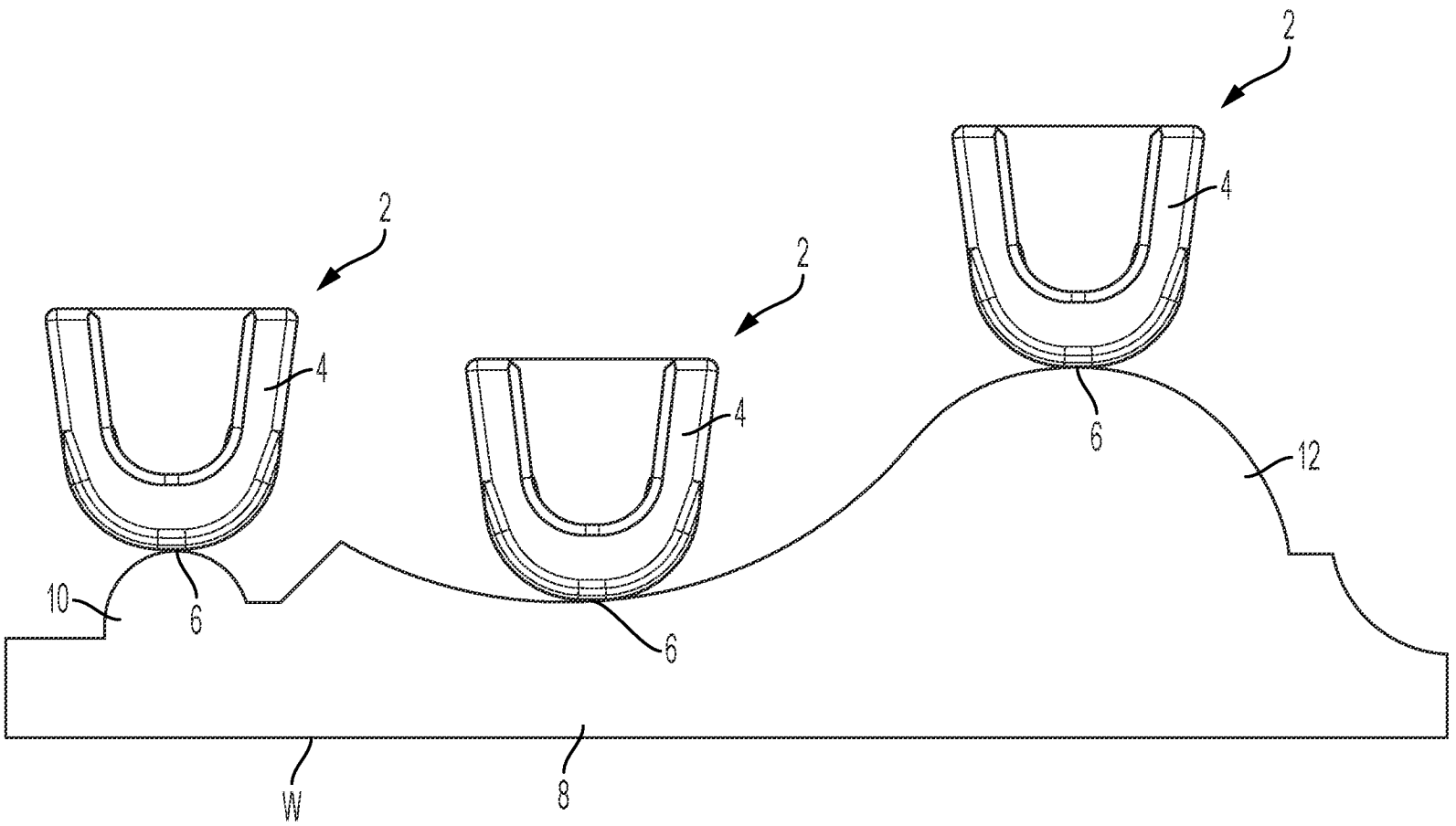
FIG. 2 PRIOR ART
FIG. 2 illustrates of an existing non-compliant tip having a point contact on a curved workpiece.
Figure 3:
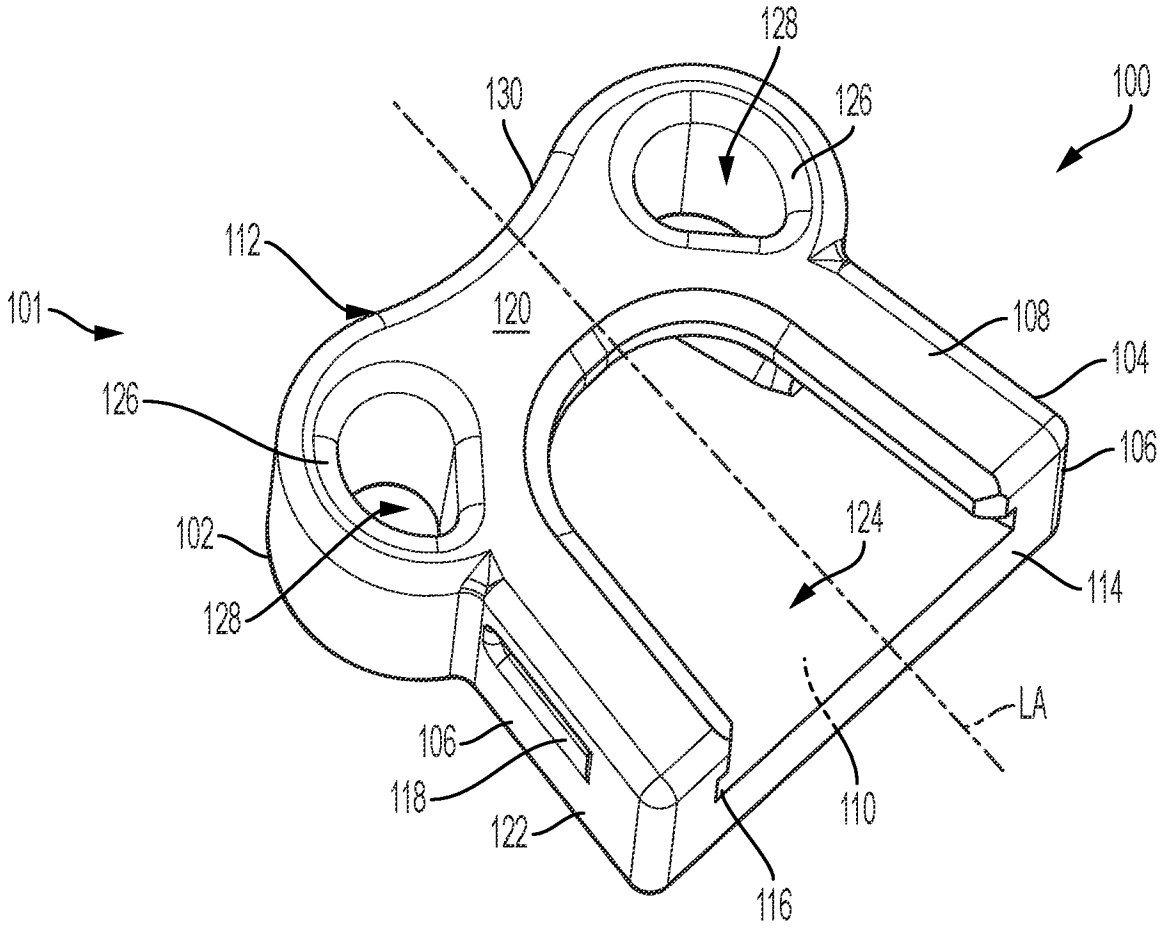
FIG. 3 illustrates is a top and rear view of an embodiment of the compliant tip member having compression areas to reduce damage to the workpiece surface.

Referring to FIG. 3, a compliant tip member 100 for a fastening tool is illustrated. The compliant tip member 100 has compressible and protective properties that not only protect the surface of a workpiece, from damage that can be caused by the rigid WCE of the tool, such as the WCE 714 in the fastening tool 700 shown in FIG. 7. The compliant tip member 100 has a unitary body 101 that is formed as a single or one-piece member. The body 101 has a longitudinal axis LA through the longitudinal center thereof, a forward section 102 and a rearward section 104 that is positioned longitudinally opposite to the forward section. Between the forward section 102 and rearward section 104 are laterally opposing faces or lateral sides 106 of the body 101 that connect the forward 102 and rearward 104 sections. The body 101 also has a substantially planar upper portion 108 and a substantially planar lower portion 110 parallel to the upper planar portion. The substantially planar upper portion 108 and the substantially planar lower portion 110 define the upper and lower surfaces of the body 101. A front wall 112 on the forward section 102 defines a workpiece contact surface. In operation, when the fastening tool is to be placed against the workpiece, the front wall 112 of the forward section 102 contacts the workpiece and protects the workpiece from the rigid or hard WCE 714 of the fastening tool. The compliant tip member 100 covering the WCE 714 serves as a buffer between the WCE and the workpiece to prevent the WCE from damaging the workpiece.

A rear wall 114 disposed in the rearward section 104 defines the location on the tip member 100 by which the WCE can interface with the tip member. The rear wall 114 is arranged parallel to and longitudinally opposite to the front wall 112 on the forward section 102. The rear wall 114 can have a planar surface that extends between the planar upper surface 108 and the planar lower surface 110. The rear wall 114 includes a notch 116 that is sized to receive the WCE, such as the nosepiece of the fastening tool. The tip member 100 can engage the WCE in a sliding manner. Lateral sides 106 of the body 101 are provided between the forward section 102 and the rearward section. The lateral sides 106 can include an aperture 118 for retaining a portion of the WCE onto the tip member 100.

The forward section 102 of the body 101 includes a compression portion 120. The compression portion is designed to compress when the tip member 100 is pressed against the surface of the workpiece. For example, the compression portion 120 is designed to compress when a force greater than the compressive force of the body 101 is exceeded.

In an embodiment, the compression portion 120 can be longitudinally compressible. A compression force is applied against the forward section 102. In another embodiment, the compression portion 120 can be laterally or angularly compressible with respect to the longitudinal axis LA, depending on the curvature of the workpiece against which the tip member is pressed and depending on the angle at which the user applies the tool to the workpiece. In an embodiment, the compression portion 120 forms at least a portion of the forward section 102. In another embodiment, the compression portion 120 forms at least a portion of the front wall 112. In a further embodiment, the entire front wall 112 is the compression portion of the tip member. In an embodiment, the rearward section 104 of the body 101 can be the area between the compression portion and the rear wall 114. In an embodiment, the lateral sides 106 include side walls 122 that are arranged between the compression portion 120 and rear walls 114.

Figure 4:
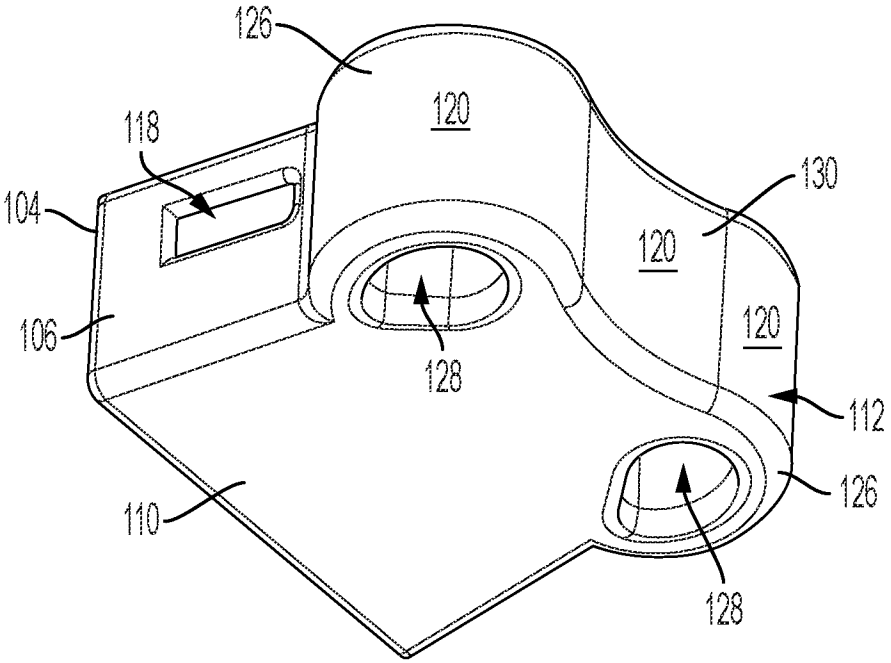
FIG. 4 illustrates a bottom view and front of the compliant tip member of the embodiment of FIG. 3.
Figure 5:
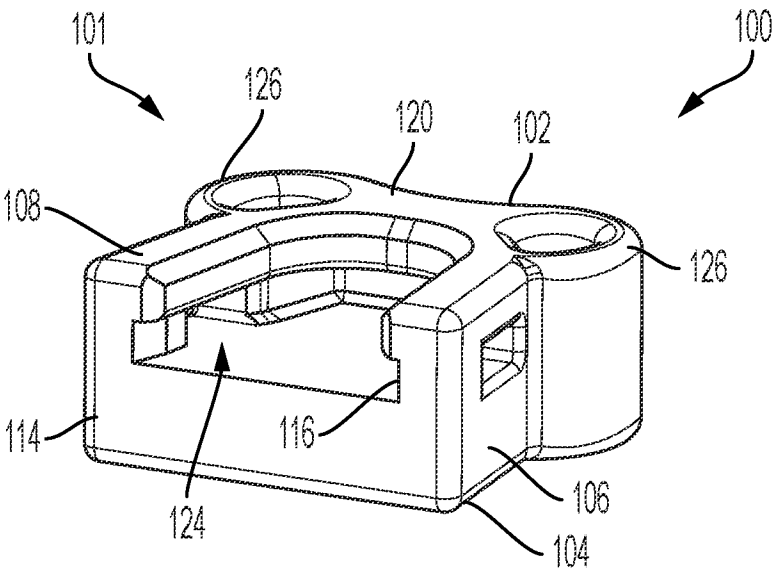
FIG. 5 illustrates a rear and side view of the compliant tip member of the embodiment of FIG. 3.

A recess 124 is located within the planar upper surface 108 of the body 101 between the forward section 102 and the rearward section 104. The recess 124 serves to receive and retain a portion of the fastening tool. In the embodiment of FIGS. 3, 4, and 5, the recess 124 can be closed toward the forward section 102 and open toward the rearward section 104, thereby having a U-shape. In an embodiment, the recess 124 is open along the rear wall 114 so as to receive and retain the WCE, such as the nosepiece of the fastening tool. The retaining portion 118 in the lateral sides 106 allows the tip member 100 to be removably coupled to the fastening tool or the fastening tool to be removably coupled to the tip member 100. In an embodiment, the retaining portion can include apertures or windows that receive locking members on the WCE. The interface of the recess 124 with the WCE allows the tip member 100 to snap fit engage the tool for use.

The body 101 of the tip member 100 is substantially resilient as it is formed from an elastomeric material. In an embodiment, the tip member 100 can be made from a non-marking, compressible material such as a thermoplastic polyurethane having a shore D hardness of 50, or another suitable elastomer. Such a material can include, but is not limited to Covestro Texin® 250. The thermoplastic polyurethane can be injection molded into the form of the tip member such that the shore hardness is uniform throughout the body 101. The shape memory of the tip member 100 resiliently returns to the non-compressed state with the removal of the force of the WCE after the tool is fired.

In an embodiment, the compression portion 120 can be disposed in the forward section 102 between the front wall 112 and the recess 124. The compression portion 120 can be configured such that even with a uniform shore hardness through the body 101, the forward section 102 is substantially compressible relative to the rearward section 104. As shown in FIGS. 3, 4 and 5, for example, the forward section 102 includes projections that protrude or extend forwardly from the body 101. The projections can be in the form of lobes 126 that project obliquely. The lobes 126 are illustrated as having a generally semi-circular shape with a bore 128 in each lobe that passes vertically therethrough.

The bore 128 increases the resiliency of the forward section 102 by providing a space for the lobe to deform when compressed under the load applied by the nose of the fastening tool. As a result, the forward section 102 is more compressible than the rearward section 104.

The bore 128 can be generally circular and follow the contour of the lobe. The bore 128 can also have a size that substantially fills the lobe portion of the compression portion 120, which allows for greater compressibility or deformation of the forward portion. The size of the bore 128 with respect to the lobe and the proximity of the bore 128 with respect to the front wall 112 determines the extent to which the forward section 102 will deform. The two lobes 126 or compression areas that define the compression portion 120 allow the compliant tip member to both compress and conform to the shape of the workpiece to increase surface area and thus decrease damage.

The front wall 112 can include a span portion 130 that is disposed between the pair of lobes 126. The span portion 130 and the pair of lobes 126 are configured to form a workpiece contact surface for the body 101. In an embodiment, the span portion 130 can be arcuate, such as for example, concave with respect to the body 101. In combination with the pair of lobes 126, the front wall 112 can have an undulating form. For example, referring to FIGS. 3, 4, and 5, in an embodiment, the forward section 102 of the body 101 can include the pair of lobes 126 having convex surfaces and a concave surface or span portion 130 therebetween that work together to conform to varying curved surfaces of a workpiece.

Figure 6A:
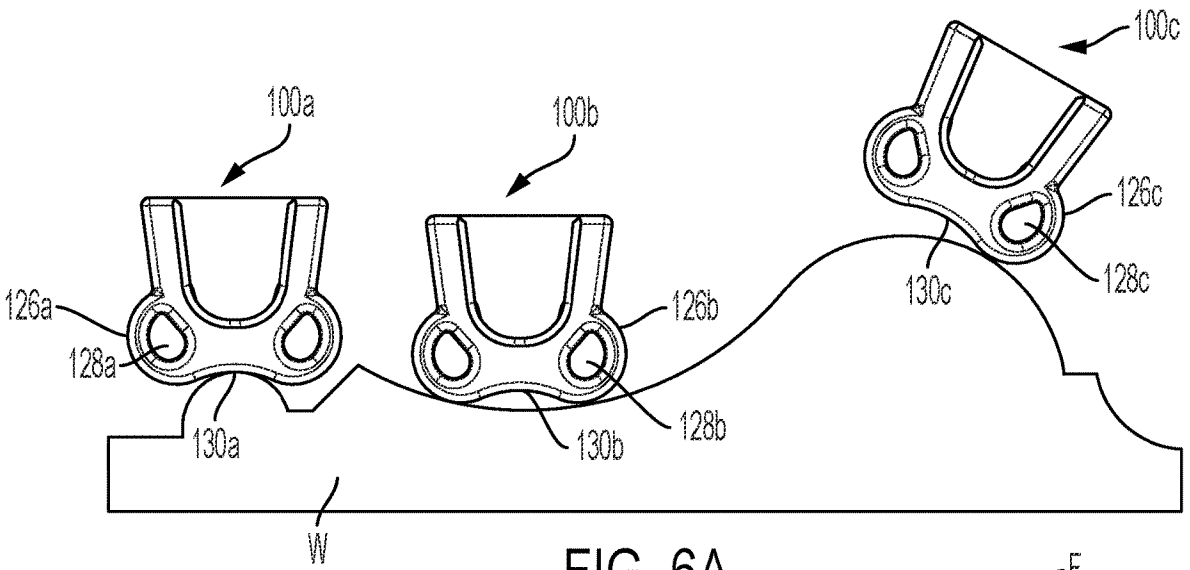
FIG. 6A illustrates the compliant tip member of the embodiment of FIG. 3 before conforming to the curvature of the workpiece.
Figure 6B:
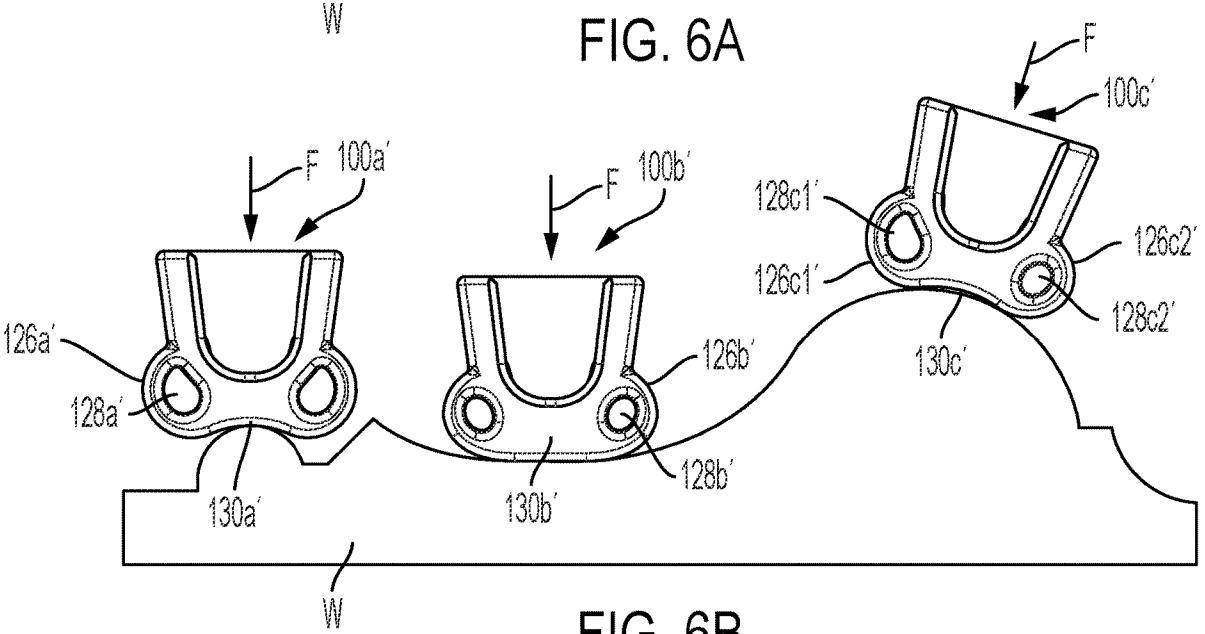
FIG. 6B illustrates the compliant tip member of the embodiment of FIG. 3 after conforming to the curvature of the workpiece.

FIGS. 6A and 6B illustrate how the concave and convex surfaces of the tip member 100 have a resiliency that allows them to maximize the types of contoured workpiece surfaces to which the tip can conform. As shown in FIGS. 3, 4 and 5, the tip member 100 includes both concave and convex surfaces so as to best interface with both concave and convex workpiece surfaces. When in use, the force of pressing the contact trip of the fastening tool would allow the tip member to compress and increase in surface area. As a result, the tip member adapts to various moulding surfaces.

As shown in FIGS. 6A and 6B, the span portion 130 flexes during compression of the forward section 102.

FIG. 6A illustrates three tip members 100*a*, 100*b*, and 100*c* at different positions along a curved workpiece W at rest before engagement with the workpiece. FIG. 6B illustrates three tip members 100*a*', 100*b*', and 100*c*' in a compressed state during engagement with the workpiece W. The curved workpiece W has concave and convex curvatures projecting from a horizontal or flat base. In FIG. 6A, the tip member 100*a* is at rest and arranged to be compressed against the convex contour of the workpiece W. The tip member 100*b* is arranged to be pressed against a concave curvature and the tip member 100*c* is arranged to be pressed against a second convex curvature that has a greater radius than the convex curvature opposite tip member 100*a*. As show in FIG. 6A, the tip members 100*a*, 100*b*, 100*c* are shown in a state where there is either no load applied by the nose of the fastening tool or the load applied by the fastening tool is does not exceed the compressive force of the body 101. In FIG. 6A, the lobes 126*a*, 126*b*, 126*c*, the bores 128*a*, 128*b*, 128*c* and span portions 130*a*, 130*b*, 130*c* of the compression portion 120 maintain their original shape. FIG. 6B illustrates when a force is applied to the tip members. When a force F is applied to the tip members, the compression portion 120 causes the forward sections 102 to deform. The tip member 100*a* does not undergo significant deformation as tip member 100*a*' because the front wall 112 of the forward section 102 has a curvature that matches the curvature of the workpiece. As such, the lobes 126*a*', bores 128*a*', and span portions 130*a*', maintain the shape of the at rest position.

The tip members 100*b*' and 100*c*' deform to conform to the contours of the workpiece. For example, the tip member 100*b*' deforms to conform to the concave workpiece surface. In particular, an axial force applied to the tip member, such as from the WCE causes the forward section 102, namely, the front wall 112 of the body 101 to be deformed radially outward into the space between the front wall 112 and the workpiece. The radial deformation results in an increase of the contact surface area of the body. As a result, the contact surface area of the forward section 102 to the workpiece increases. The lobes 126*b*', bores 128*b*', and span portions 130*b*', deform and the bores are smaller than in the tip member of 100*b*.

The tip member 100*c*' in FIG. 6B, for example, is illustrates as being compressed against a convex surface of the workpiece W at a non-right angle with respect to the base of the workpiece. As shown, the leading bore 126*c*1' located at a greater distance from the base of the workpiece than the trailing bore, maintains a substantially non-compressed or at-rest shape. In contrast, the trailing bore 126*c*2' deforms under the pressure of the WCE. As a result, the forward section 102 is able to conform to the curvature of the workpiece at an angle.

In an embodiment, the compression portion 120 can include a plurality of bores, such as three, four or more bores, and each bore can be deformed to different extents depending on the angle at which the compliant tip member engages the curvature of the workpiece.

Figure 7:
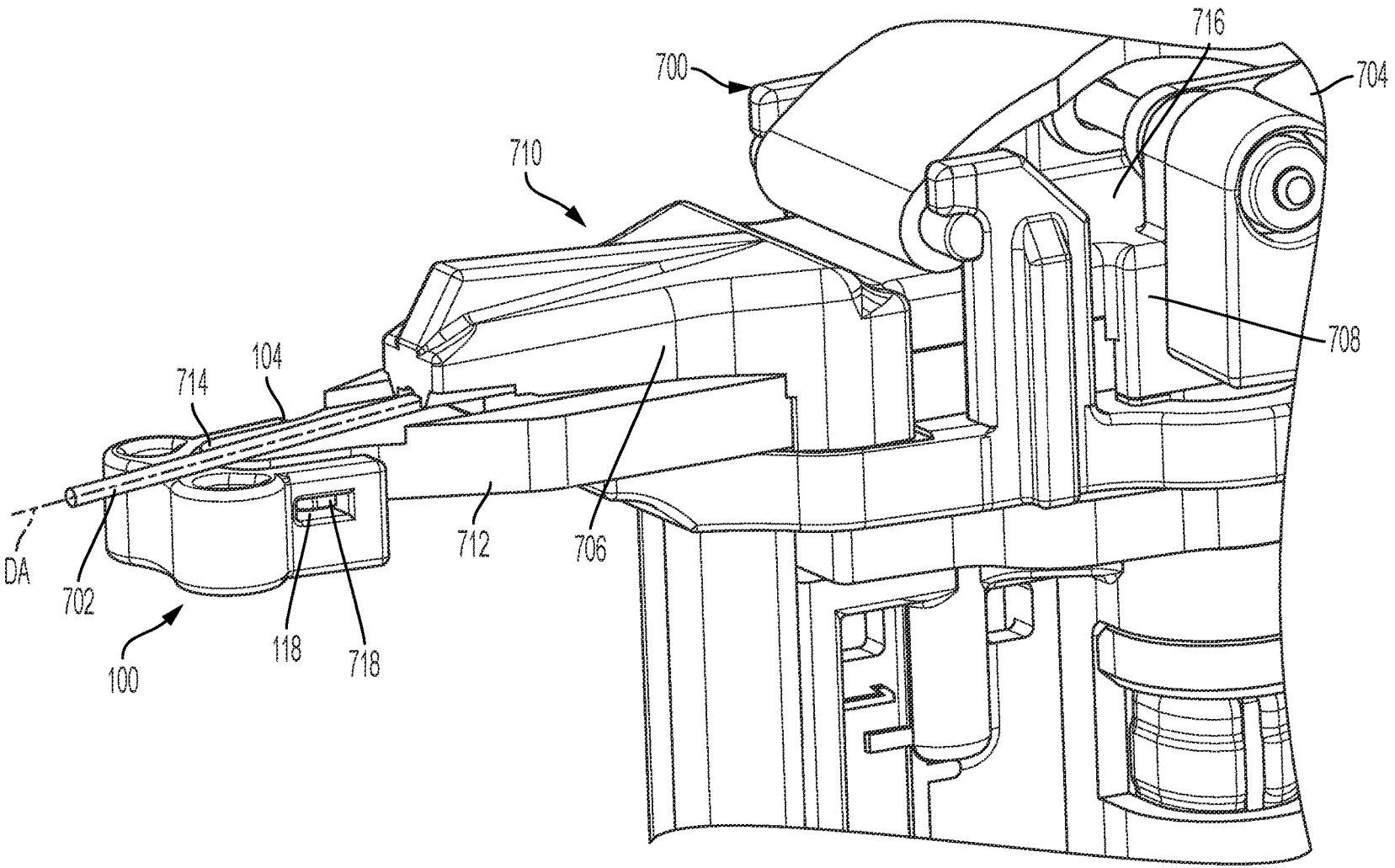
FIG. 7 illustrates the compliant tip member of the embodiment of FIG. 3 coupled to the fastening tool and with respect to the path of the fastener.

FIG. 7 illustrates the compliant tip 100 installed on the nosepiece of a fastening tool 700 for use in driving a fastener 702 into a workpiece. The fastening tool 700 includes a housing assembly 704 having a fastener drive track 706 defined therein. A fastener driver 708 is reciprocally mounted for movement within the fastener drive track along a drive axis DA. A nosepiece assembly 710 is connected to the housing 704 and includes a nose portion 712 having a longitudinal body with a nosepiece tip 714 at a distal end. A power operated system 716 is carried by the housing 704 and configured to drive the fastener 702 along the drive axis DA out of the fastener drive track 706 and into the workpiece through successive operating cycles each including a drive stroke and a return stroke. An actuating mechanism (not shown) includes a trigger assembly constructed and arranged to actuate the power operated system in response to a predetermined movement of the actuation mechanism.

The compliant tip member 100 disposed on the tip 714 of the nose portion has body 101 formed with the forward section 102 including a compression portion 120 and a rearward section 104. The compression portion 120 has at least one bore that deforms when the compression portion is pressed against a workpiece W. The workpiece illustrated is one example of an infinite number of different workpieces having different contours.

The compliant tip member 100 in the exemplary embodiment shown in FIG. 3, is retained on the tip 714 of the nosepiece by the recess 124 in the body 101 and by locking members on the nosepiece 712. The recess 124 is provided on the rearward section 104 of the body 101 and provides an interference-fit engagement about the WCE 714. The locking members can be in the form of tabs 718 that extend from the side of the nosepiece 712. The tabs 718 can lock into the compliant tip member 100 through receiving windows or apertures in the body 101. In the example, provided, the lateral sides 106 of the body 101 include apertures or windows 160 through the side walls 118, within which the tabs 718 are received. The proximal end of the compliant tip member engages the nosepiece and the distal end of the compliant tip member will engage the workpiece.

In an embodiment, the fastener exit from the nose of the fastening tool 700 is across the planar upper surface 108 of the tip member 100 or outside of the tip member. As such, the fastener 702 does not travel through the tip member 100.

In an alternative embodiment, the tip member can include an aperture through at least the front wall, to allow a driven fastener to pass therethough.

Figure 8:
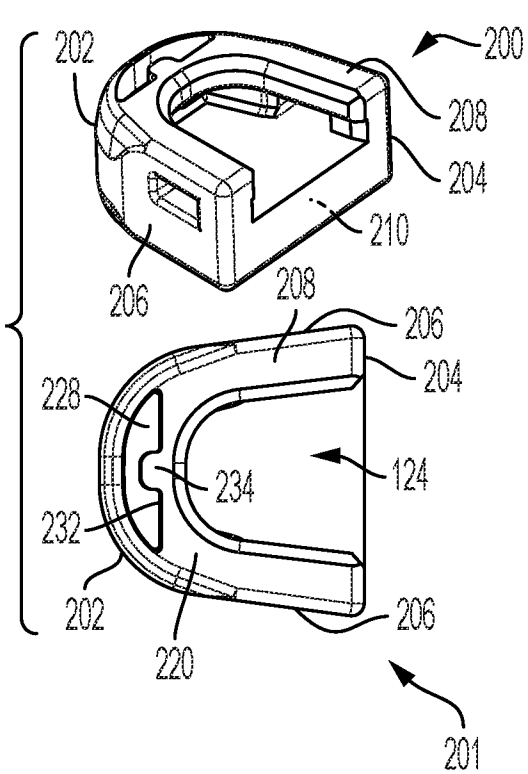
FIG. 8 illustrates a second embodiment of the compliant tip member.

In a second embodiment of the compliant tip member as shown in FIG. 8, the compliant tip member 200 can also have a compression portion 220 formed of a vertically oriented slot 228 that passes through the forward section 202 from the planar upper surface 208 through the planar lower surface 210. The body 201 of the tip member also includes a rearward section 204 and lateral sides 206. The slot 228 extends across the forwardmost portion of the forward section 202, thereby allowing a forwardmost portion of the forward section to deform. The slot 228 has an inner wall 232 that can include a compression limiting member 234. The compression limiting member 234 can protrude from the inner wall 232 of the slot 228 into the slotted space to limit the amount of deformation that the slot can undergo when the tip member is pressed against the surface of the workpiece. Limiting the amount of deformation that the slot can undergo serves the purpose of improving the durability of the tip member. Although a single compression limiting member is shown, it is contemplated that more than one or a plurality of compression limiting members can be included on the inner wall of the slot.

Figure 9:
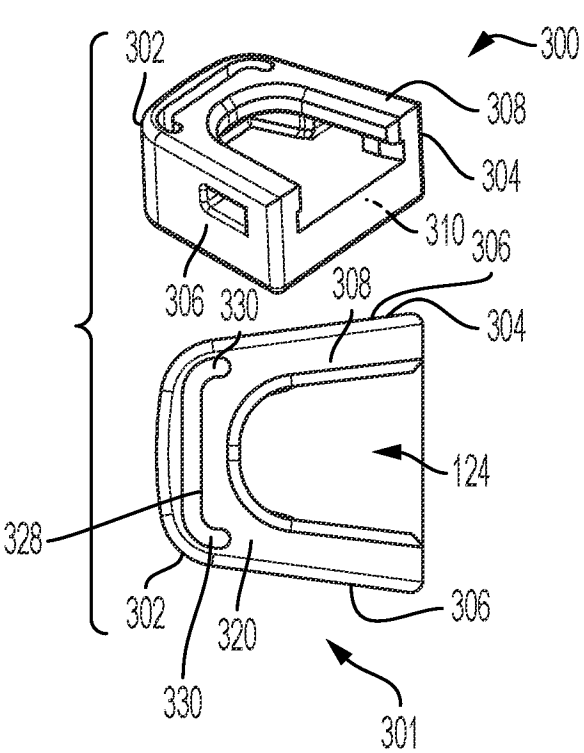
FIG. 9 illustrates a third embodiment of the compliant tip member.

In a third embodiment of the compliant tip member as shown in FIG. 9, the compliant tip member 300 has a body 301 that includes a rearward section 304, lateral sides 306, an upper planar portion 308 and a lower planar portion 310. The tip member 300 can also have a compression portion 320 that includes a vertically oriented slot 328 that passes through the forward section 302 from the planar upper surface through the planar lower surface. The slot 328 can extend across the entire forward section 302 thereby allowing the entire forward section to deform. The slot 328 can be a linear slot having a longitudinal axis. Alternatively, the slot can have notched ends 330 having longitudinal axes that are disposed orthogonally from the longitudinal axis of the slot. The notched ends 330 allow the tip member 300 to deform when the tip member is at an angle to the workpiece, such as the angle of tip member 100*c*' shown in FIG. 6B.

Figure 10:
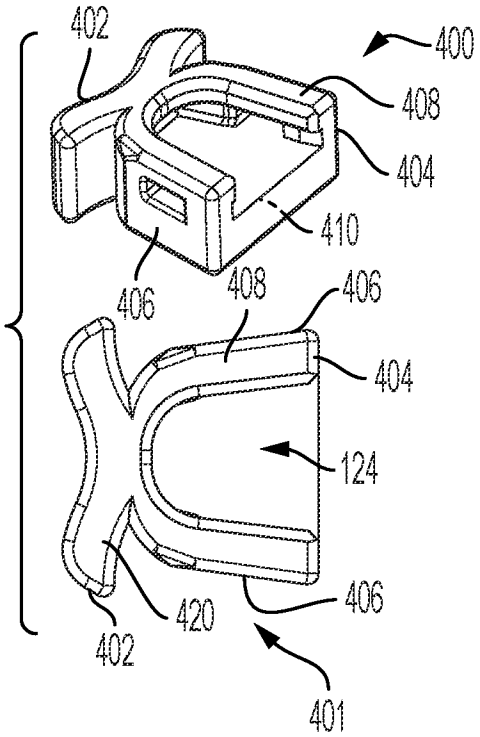
FIG. 10 illustrates a fourth embodiment of the compliant tip member.
Figure 11:
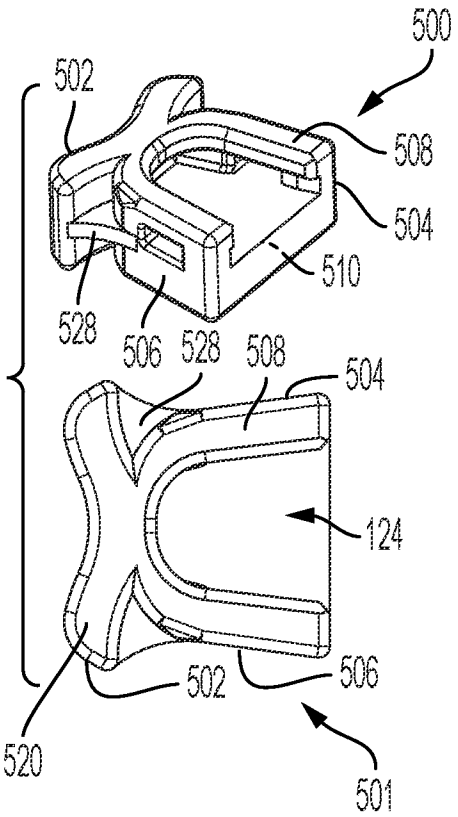
FIG. 11 illustrates a fifth embodiment of the compliant tip member.

In fourth and fifth embodiments of the compliant tip members 400 and 500, respectively, as shown FIGS. 10 and 11, can also have projections that are in the form of a pair of wings 420, 520. In an embodiment, the wings 420, 520 ensure that the forward sections 402, 502 of the body 401, 501 has a greater width than the rearward section 404, 504 of the body. The wings further ensure a greater contact surface to the workpiece. Further, the space between the trailing edge of the wing and the body 401, 501 allows the wings to flex during compression thereby increasing the surface area of the body at the forward section 402, 502. As a result, the tip members 400, 500 conform to the shape of the workpiece and reduce the risk of damage. The wings can extend from planar upper portion 408, 508 that is parallel to the planar lower portion 410, 510. The wings can extend beyond the width of lateral sides 406, 506.

As further shown in FIG. 11, the projections can be formed of a pair of webbed wings 520. The webbing 528 connecting the wings and the non-projection part of the body keeps the wings from tearing or breaking off if the user drags the tool on the workpiece surface, and ensures that the wings 520 retract back to the rest position after being deformed under the load applied by the WCE.

Figure 12:
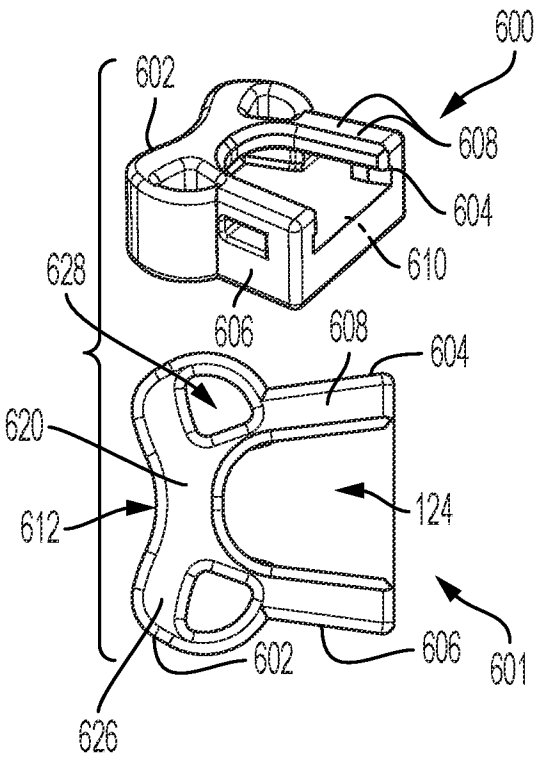
FIG. 12 illustrates a sixth embodiment of the compliant tip member.

In a sixth embodiment of the compliant tip member 600 as shown in FIG. 12, the body is similar to the first embodiment of FIG. 3. The tip member 600 includes a forward section 602, a rearward section 604 and lateral sides 606, a planar upper surface 608 and a planar lower surface 610. The compliant tip member can have lobes 626 projecting forwardly from the body 601 and bores 628 vertically disposed through the lobe. The placement of the bores 628 farther away from the front wall 612 than in the FIG. 3 provides for a different compression of the forward section 602, suitable for example, for driving fasteners into curved surfaces longitudinally.

While aspects of the present invention are described herein and illustrated in the accompanying drawings in the context of a fastening tool, those of ordinary skill in the art will appreciate that the invention, in its broadest aspects, has further applicability.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made, and equivalents may be substituted for elements thereof without departing from the scope of the present disclosure. Furthermore, the mixing and matching of features, elements and/or functions between various examples is expressly contemplated herein, even if not specifically shown or described, so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description.

We claim:

1. A compliant tip member for a fastening tool comprising:

a body having longitudinal axis, a forward section, a rearward section longitudinally opposite to the forward section and at least two lateral sides aligned on opposite sides of the longitudinal axis connecting the forward and rearward sections, and an upper surface extending from the forward section to the rearward section and between the at least two lateral sections, the upper surface being contiguous and substantially planar;

a compression portion forming at least a portion of the forward section and being compressible relative to the rearward section; and a recess within the upper surface of the body, the recess being closed toward the forward section and open toward the rearward section, wherein, the compression portion comprises at least one bore passing vertically through the forward section.

2. The compliant tip member according to claim 1, wherein the body is unitary.

3. The compliant tip member according to claim 1, wherein the body is substantially resilient.

4. The compliant tip member according to claim 1, wherein the body is formed from an elastomeric material.

5. The compliant tip member according to claim 1, wherein the forward section includes a workpiece contact surface.

6. The compliant tip member according to claim 1, wherein the compression portion is longitudinally compressible.

7. The compliant tip member according to claim 1, wherein the compression portion is angularly compressible with respect to the longitudinal axis through the body.

8. The compliant tip member according to claim 1, wherein, when compressed, the at least one bore in the compression portion deforms.

9. The compliant tip member according to claim 1, wherein the recess is configured to receive and retain a work contact element.

10. The compliant tip member according to claim 1, wherein the body includes a retaining portion for removably coupling the fastening tool.

11. A compliant tip member for a fastening tool comprising:

a body having longitudinal axis, a forward section, a rearward section longitudinally opposite to the forward section and at least two lateral sides aligned on opposite sides of the longitudinal axis connecting the forward and rearward sections, and an upper surface extending from the forward section to the rearward section and between the at least two lateral sections, the upper surface being contiguous and substantially planar;

a compression portion forming at least a portion of the forward section and being compressible relative to the rearward section; and a recess within the upper surface of the body, the recess being closed toward the forward section and open toward the rearward section, wherein the compression portion comprises projections protruding forwardly on the forward section, and wherein the projections comprise a pair of lobes, each of the lobes having a bore passing vertically therethrough.

12. A compliant tip member for a fastening tool comprising:

a body having longitudinal axis, a forward section, a rearward section longitudinally opposite to the forward section and at least two lateral sides aligned on opposite sides of the longitudinal axis connecting the forward and rearward sections, and an upper surface extending from the forward section to the rearward section and between the at least two lateral sections, the upper surface being contiguous and substantially planar;

a compression portion forming at least a portion of the forward section and being compressible relative to the rearward section; and a recess within the upper surface of the body, the recess being closed toward the forward section and open toward the rearward section, wherein the compression portion comprises projections protruding forwardly on the forward section, and wherein the projections comprise a pair of wings.

13. A compliant tip member for a fastening tool comprising:

a body having longitudinal axis, a forward section, a rearward section longitudinally opposite to the forward section and at least two lateral sides aligned on opposite sides of the longitudinal axis connecting the forward and rearward sections, and an upper surface extending from the forward section to the rearward section and between the at least two lateral sections, the upper surface being contiguous and substantially planar;

a compression portion forming at least a portion of the forward section and being compressible relative to the rearward section; and a recess within the upper surface of the body, the recess being closed toward the forward section and open toward the rearward section, wherein the compression portion comprises projections protruding forwardly on the forward section, and wherein the projections comprise a pair of webbed wings.

14. A compliant tip member for a fastening tool comprising:

a body having longitudinal axis, a forward section, a rearward section longitudinally opposite to the forward section and at least two lateral sides aligned on opposite sides of the longitudinal axis connecting the forward and rearward sections, and an upper surface extending from the forward section to the rearward section and between the at least two lateral sections, the upper surface being contiguous and substantially planar;

a compression portion forming at least a portion of the forward section and being compressible relative to the rearward section; and a recess within the upper surface of the body, the recess being closed toward the forward section and open toward the rearward section, wherein the compression portion comprises a slot having an inner wall, and wherein the compression portion further comprises at least one compression limiting member protruding from the inner wall of the slot.

15. A compliant tip member for a fastening tool comprising:

a body having a longitudinal axis, a forward section, a rearward section longitudinally opposite to the forward section and lateral sides connecting the forward and rearward sections;

a pair of lobes forming at least a portion of the forward section and being compressible relative to the rearward section each of the lobes having a bore extending completely through the lobe, perpendicularly to the longitudinal axis and through the forward section;

a span portion connecting the pair of lobes; and a retaining portion for retaining a fastening tool on the body.

16. The compliant tip member according to claim 15, wherein the pair of lobes protrude obliquely from the forward section.

17. The compliant tip member according to claim 15, wherein the retaining portion comprises a recess between the forward section and the rearward section.

18. The compliant tip member according to claim 15, wherein the span portion is arcuate.

19. The compliant tip member according to claim 15, wherein the span portion and the lobes are configured to form a workpiece contact surface for the body.

20. The compliant tip member according to claim 15, wherein the body is substantially resilient.

21. The compliant tip member according to claim 15, wherein the body is formed from an elastomeric material.

22. The compliant tip member according to claim 15, wherein the forward section is substantially compressible relative to the rearward section.

23. The compliant tip member according to claim 15, wherein when compressed, at least one bore in the pair of lobes deforms.

24. The compliant tip member according to claim 15, wherein when compressed against a workpiece, the forward section deforms to increase a contact surface area between the compliant tip and the workpiece.

25. A fastening tool for use in driving a fastener into a workpiece, the fastening tool comprising:

a housing assembly having a fastener drive track defined therein;

a fastener driver reciprocally mounted for movement within the fastener drive track along a drive axis;

a nosepiece assembly connected to the housing, the nosepiece assembly including a nose portion having a longitudinal body with a tip at a distal end;

a power operated system carried by the housing and configured to drive the fastener along the drive axis out of the fastener drive track and into the workpiece through successive operating cycles each including a drive stroke and a return stroke; and a tip member disposed on the tip of the nose portion, the tip member having a body formed with a forward section including a compression portion and a rearward section, the compression portion having at least one bore extending completely through the lobe, that deforms when the compression portion is pressed against the workpiece.

26. The fastening tool according to claim 25, wherein the tip member comprises a recess for retaining the tip of the nose portion.

27. The fastening tool according to claim 25, wherein the body is substantially resilient.

28. The fastening tool according to claim 25, wherein the body is formed from an elastomeric material.

29. The fastening tool according to claim 25, wherein the tip member is removably coupled to the nosepiece.

30. The fastening tool according to claim 25, wherein the unitary body comprises laterally opposing apertures for retaining a locking portion of the nosepiece.

31. The fastening tool according to claim 25, wherein the body includes a retaining portion for removably coupling the fastening tool.

* * * * *